US009376795B1

(12) United States Patent
Gaffaney et al.

(10) Patent No.: US 9,376,795 B1
(45) Date of Patent: Jun. 28, 2016

(54) URINE SPLATTER COLLECTION DEVICE

(71) Applicants: Brian William Gaffaney, Coon Rapids, MN (US); Richard David Gaffaney, Alexandria, MN (US)

(72) Inventors: Brian William Gaffaney, Coon Rapids, MN (US); Richard David Gaffaney, Alexandria, MN (US)

( * ) Notice: Subject to any disclaimer, the term of this patent is extended or adjusted under 35 U.S.C. 154(b) by 0 days.

(21) Appl. No.: 14/968,371

(22) Filed: Dec. 14, 2015

Related U.S. Application Data

(60) Provisional application No. 62/094,972, filed on Dec. 20, 2014.

(51) Int. Cl.
*E03D 13/00* (2006.01)
*E03D 9/00* (2006.01)

(52) U.S. Cl.
CPC . *E03D 13/00* (2013.01); *E03D 9/00* (2013.01)

(58) Field of Classification Search
CPC ..... E03D 13/00; E03D 9/00
USPC ..... 4/310, 144.1, 902
See application file for complete search history.

(56) References Cited

U.S. PATENT DOCUMENTS 3,594,829 A * 7/1971 Seek ..... E03D 13/00 4/310
7,805,869 B1 * 10/2010 Pascarelli ..... G09F 1/08 4/310

* cited by examiner

*Primary Examiner* — Tuan N Nguyen
(74) *Attorney, Agent, or Firm* — Dave Alan Lingbeck

(57) ABSTRACT

A urine splatter collection device for maintaining a clean and sanitary place to defecate. The urine splatter collection device includes a receptacle with a back wall, side walls, a top wall, an overhanging wall, a bottom wall, a barrier wall and channels separating the top wall from the side wall.

3 Claims, 2 Drawing Sheets

URINE SPLATTER COLLECTION DEVICE

CROSS-REFERENCE TO RELATED APPLICATIONS

The present application claims priority to the provisional application Ser. No. 62/094,972, filed on Dec. 20, 2014, the disclosure of which is expressly incorporated by reference herein in its entirety.

BACKGROUND OF THE INVENTION

1. Field of the Invention

The present invention relates to urinals and toilets and more particularly pertains to a new urine splatter collection device for maintaining a clean and sanitary place to defecate.

2. Description of the Prior Art

The use of urinals and toilets is known in the prior art. More specifically, urinals and toilets heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a collar having paired opposed arcuate sections and paired opposed elongated sections together forming a generally oval configuration. Further included is an inner flange disposed downward from an inner edge of the collar. The flange is in generally frictional communication with an interior edge of the toilet bowl for ease of removal, cleaning, and reinstallation. A baffle is oriented on an outer edge of a rearward arcuate section of the collar. Another prior art includes an annular sheet with a central opening. A down-turned flange is arranged at an inner edge of the sheet, and an upturned flange is arranged at an outer edge of the sheet. A tongue is arranged at a rear end of the sheet. The guard is positioned on a toilet rim, with the tongue inserted between the hinges of the toilet seat to prevent the guard from rotating. The inner diameter of the guard is slightly smaller than an inner diameter of the toilet rim. The guard is centered about the toilet rim by having the down-turned flange engaged around the inner edge of the toilet rim. Yet, another prior art includes a strip of flexible material having top edge, a bottom edge, and an intermediate portion therebetween, the bottom edge formed with a pair of opposed and spaced lips extended downwards therefrom and thereby defining a mouth for coupling about a rim of a urinal and with the intermediate portion extended to the top edge, whereby when a rim of a urinal is disposed within the mouth, the strip is coupled to the rim and extends to a position for directing urine drippings towards the urinal. While these devices fulfill their respective, particular objectives and requirements, the aforementioned patents do not disclose a new urine splatter collection device.

SUMMARY OF THE INVENTION

The general purpose of the present invention, which will be described subsequently in greater detail, is to provide a new urine splatter collection device which has many of the advantages of the urinals and toilets mentioned heretofore and many novel features that result in a new urine splatter collection device which is not anticipated, rendered obvious, suggested, or even implied by any of the prior art urinals and toilets, either alone or in any combination thereof. The present invention includes a receptacle with a back wall, side walls, a top wall, an overhanging wall, a bottom wall, a barrier wall and channels separating the top wall from the side wall, and also includes a water pipe disposed through the top wall to provide water to flush the receptacle. None of the prior art includes the combination of the elements of the present invention.

There has thus been outlined, rather broadly, the more important features of the urine splatter collection device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new urine splatter collection device which has many of the advantages of the urinals and toilets mentioned heretofore and many novel features that result in a new urine splatter collection device which is not anticipated, rendered obvious, suggested, or even implied by any of the prior art urinals and toilets, either alone or in any combination thereof.

Still another object of the present invention is to provide a new urine splatter collection device for maintaining a clean and sanitary place to defecate.

Still yet another object of the present invention is to provide a new urine splatter collection device that allows urine that had splattered outside the receptacle to effectively drain back into the receptacle rather than on the floor.

Even still another object of the present invention is to provide a new urine splatter collection device that prevents the potential transmission of diseases.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
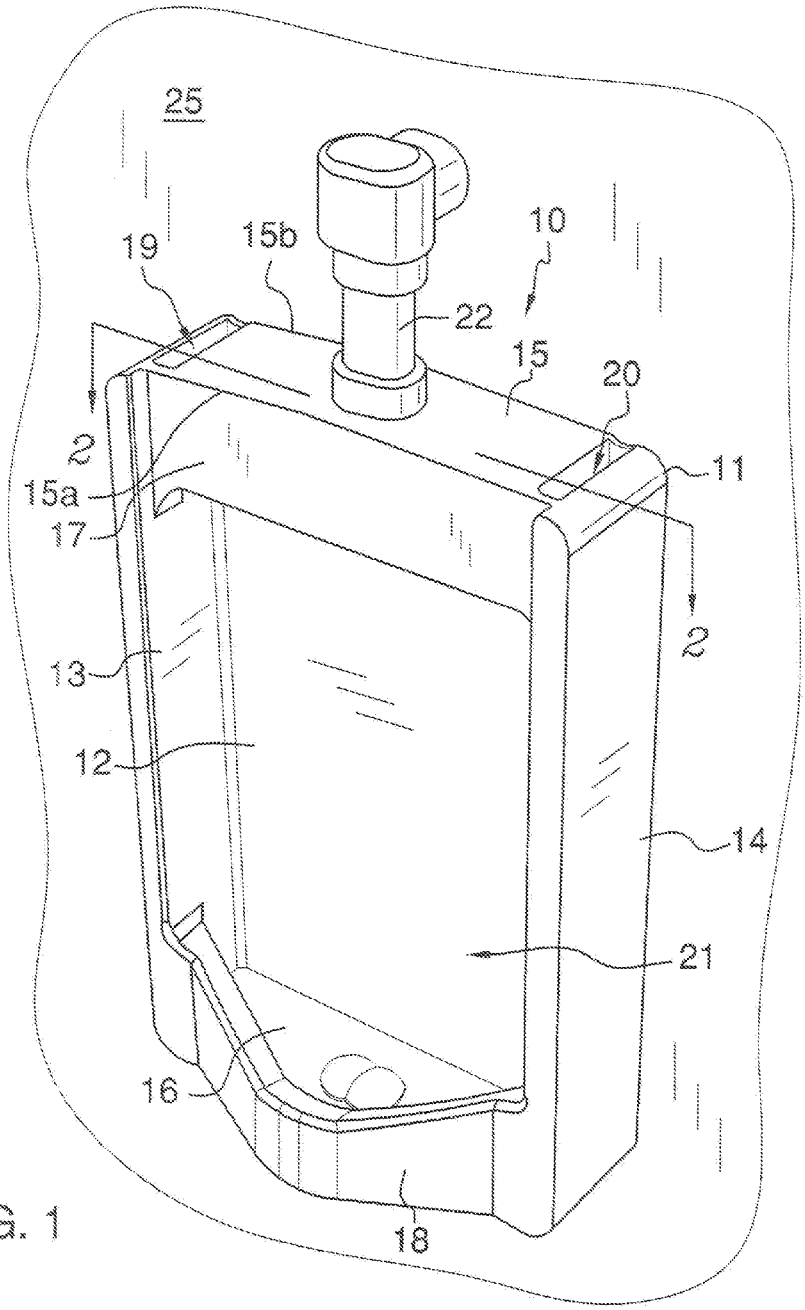
FIG. 1 is a front perspective view of a new urine splatter collection device according to the present invention.
Figure 2:
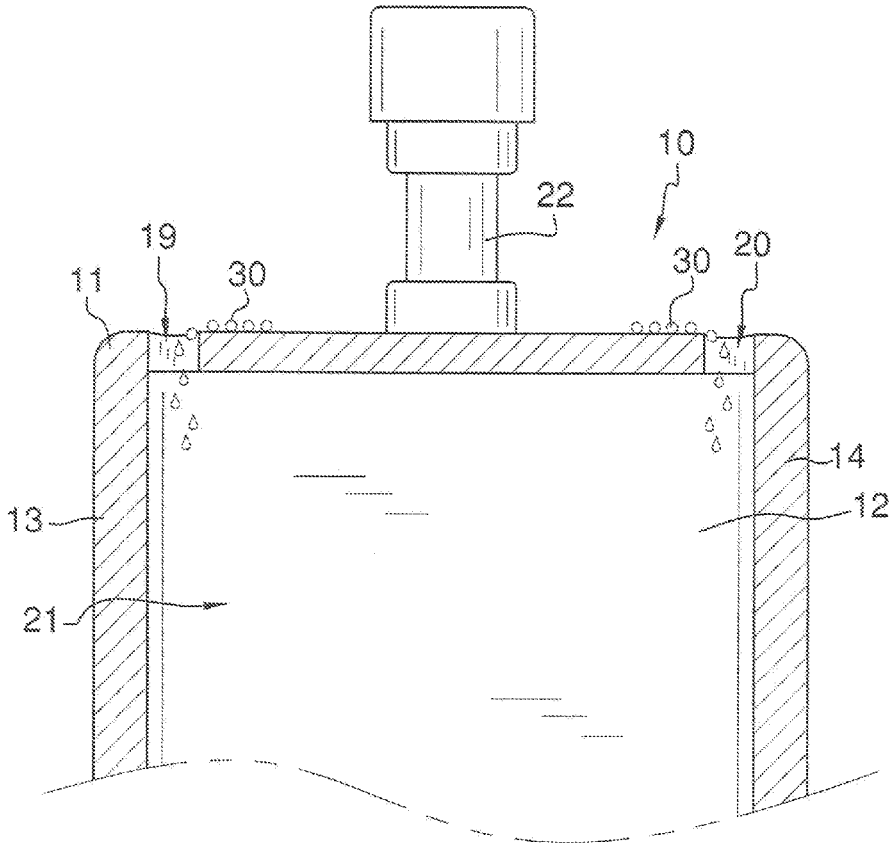
FIG. 2 is a front cross-sectional elevation view of the present invention.

With reference now to the drawings, and in particular to FIGS. 1 and 2 thereof, a new urine splatter collection device embodying the principles and concepts of the present invention and generally designated by the reference numeral 10 will be described.

As best illustrated in FIGS. 1 and 2, the urine splatter collection device 10 generally may comprise a receptacle 11 conventionally mounted to a structure 25 and having a back wall 12, a top wall 15, a bottom wall 16 with a drainage hole 23 disposed therethrough, and may also comprise opposed side walls 13, 14, an overhanging wall 17 conventionally depending from the top wall 15 and conventionally interconnecting the side walls 13, 14, and may further comprise a barrier wall 18 spaced forwardly of the back wall 12 and integrally extending upwardly from the bottom wall 16 and also integrally interconnecting the side walls 13, 14, all of which form a urine collection area 21 in the receptacle 11. The urine splatter collection device 10 may also comprise a water pipe 22 conventionally disposed through the top wall 15 to provide water to flush the receptacle 11.

The top wall 15 may have a front edge 15*a* and a back edge 15*b* which is conventionally attached to the back wall 12. The overhanging wall 17 may be conventionally attached along the front edge 15*a* of the top wall 15 and may be spaced forwardly from the back wall 12 and spaced vertically from the barrier wall 18. The back wall 12 may be conventionally mounted to the structure 25 with the opposed side walls 13, 14 extending generally perpendicular to the back wall 12 and outwardly from the structure 25. The top wall 15 may also extend generally perpendicular to the back wall 12 and to the side walls 13, 14 and outwardly from the structure 25. The receptacle 11 may further include channels 19, 20 forming openings each extending into and completely through the top wall 15 and separating the top wall 15 from a respective one of the side walls 13, 14 and exposed to the outside of the receptacle 11 and also exposed into the urine collection area 21 of the receptacle 11 with the top wall 14 spaced from the side walls 13, 14 as illustrated in the Figures to allow any urine 30 splattered outside the receptacle 11 above the top wall 15 to drain back into the urine collection area 21. Each of the openings 19, 20 may extend a width of the top wall 15 and may extend from the back wall 12 to the overhanging wall 17. The top wall 5 may have opposed ends 15*c*, 15*d* which in cooperation with the opposed side walls 13, 14 form the openings 19, 20 therebetween. Each of the openings 19, 20 may have a longitudinal axis disposed perpendicular to the top wall 15. In addition, the side walls 13, 14 may extend forwardly of the top wall 15 and the overhanging wall 17 to further collect any splattered urine 30.

In use, a user may be positioned before and urinates into the receptacle 11 and the urine collection area 21. While urinating into the receptacle 11, the user may spray urine 30 above the receptacle 11 onto the top wall 15. Instead of the sprayed urine 30 dripping onto and contaminating a floor, the sprayed urine 30 may drain through the openings 19, 20 into the urine collection area 21 which may prevent unhealthy conditions and possibly the transmission of diseases.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the urine splatter collection device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A urine splatter collection comprising:

a receptacle mounted to a structure and having a back wall, a top wall, and a bottom wall with a drainage hole disposed therethrough, wherein the receptacle also has opposed side walls, an overhanging wall depending from the top wall and interconnecting the side walls and further has a barrier wall spaced forwardly of the back wall and extending upwardly from the bottom wall and also interconnecting the side walls all of which form a urine collection area, wherein the top wall has a front edge and a back edge which is attached to the back wall, wherein the overhanging wall is integrally attached along the front edge of the top wall and is spaced forwardly from the back wall and spaced vertically from the barrier wall, wherein the receptacle further includes channels forming openings located between the front edge and the back edge, each of the openings extends into and completely through the top wall and separating the top wall from a respective one of the opposed side walls and with the openings exposed outside of the receptacle and also exposed into the urine collection area of the receptacle to allow any urine splattered outside the receptacle above the top wall to drain back into the urine collection area through the openings; and a water pipe disposed through the top wall to provide water to flush the receptacle.

2. The urine splatter collection device as described in claim 1, wherein each of the openings extends a width of the top wall from the back wall to the overhanging wall, wherein the top wall has opposed ends which in cooperation with the opposed side walls form the openings therebetween with the top wall spaced from the sides walls, wherein each of the openings have a longitudinal axis disposed perpendicular to the top wall.

3. A method of using the urine splatter collection device as described in claim 1, the method comprising the steps of:

urinating into the urine collection area; and draining any urine splattered outside the receptacle above the top wall to drain back into the urine collection area through the openings to prevent the sprayed urine from dripping onto and contaminating a floor.

* * * * *